United States Patent [19]

Micai et al.

[11] 4,068,493

[45] Jan. 17, 1978

[54] SUCTION ACCUMULATOR FOR REFRIGERATION SYSTEMS

[75] Inventors: William Micai, Trenton, N.J.; Daniel Kramer, Yardley, Pa.

[73] Assignee: Kramer Trenton Company, Trenton, N.J.

[21] Appl. No.: 663,867

[22] Filed: Mar. 4, 1976

[51] Int. Cl.[2] ..... F25B 43/00

[52] U.S. Cl. ..... 62/194; 62/503; 137/172

[58] Field of Search ..... 62/83, 174, 471, 472, 62/503, 192, 194, 225; 137/172

[56] References Cited

U.S. PATENT DOCUMENTS

| | | | |
|---|---|---|---|
| 2,632,304 | 3/1953 | White, Jr. | 62/503 X |
| 2,709,340 | 5/1955 | Webber | 62/225 |
| 2,984,360 | 5/1961 | Smith | 137/172 X |
| 3,214,932 | 11/1965 | Grant | 62/503 X |
| 3,636,723 | 1/1972 | Kramer | 62/503 X |
| 3,779,035 | 12/1973 | Kramer | 62/503 |
| 3,792,594 | 2/1974 | Kramer | 62/503 |

*Primary Examiner*—Ronald C. Capossela
*Attorney, Agent, or Firm*—Daniel E. Kramer

[57] ABSTRACT

A suction accumulator for refrigeration systems having a tank with an inlet fitting for conveying it to refrigerant vapor from the evaporator which is mixed with oil and at times with liquid refrigerant. The tank has an outlet fitting for conveying away the refrigerant vapor from which the oil and liquid refrigerant have been separated. An oil return conduit is located underneath the tank. One end of the oil return conduit is connected into the bottom of the tank; the other end to the outlet fitting of the accumulator. Located within this oil return conduit is a thermostatic expansion valve whose bulb is located on the oil return conduit between the tank and the expansion valve. This bulb senses low superheat when liquid refrigerant is in the tank and in the conduit, and causes the expansion valve to close when liquid refrigerant is present, preventing the flow of large amounts of the liquid refrigerant into the outlet conduit. When no liquid refrigerant, but only oil, is present, the bulb senses superheat and causes the expansion valve to open, allowing relatively free flow of the oil from the accumulator tank into the outlet conduit. Another discriminating device is a float whose specific gravity is such that it floats in liquid halocarbon but sinks in oil.

16 Claims, 5 Drawing Figures

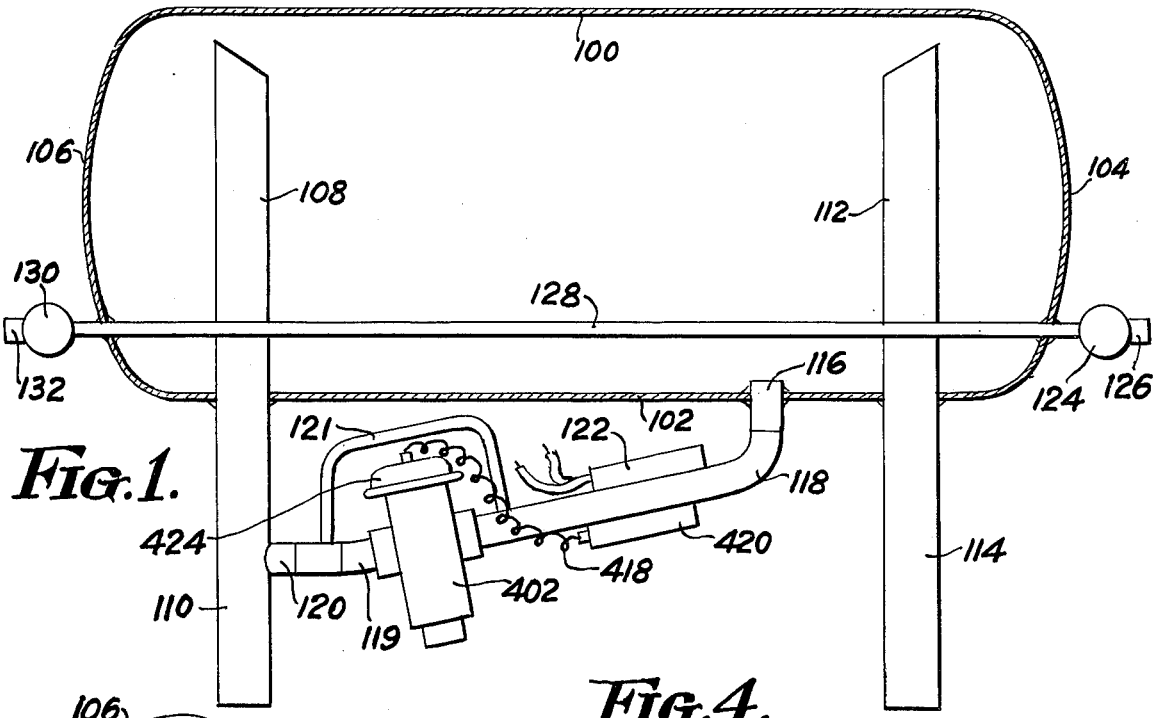
FIG. 1.
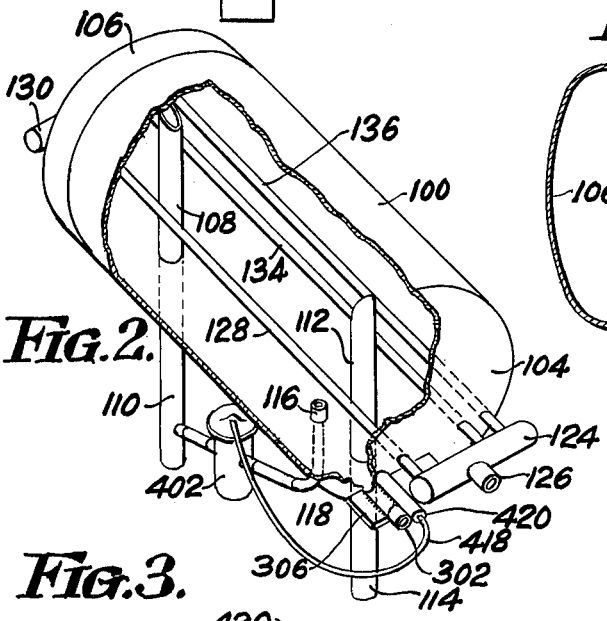
FIG. 2.
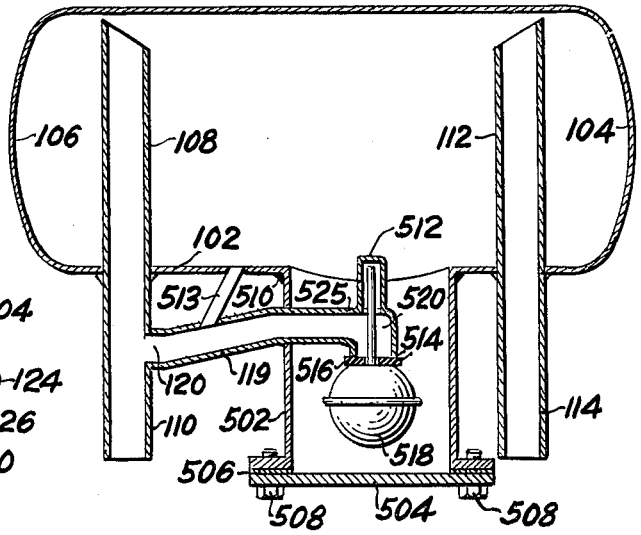
FIG. 4.
FIG. 3.
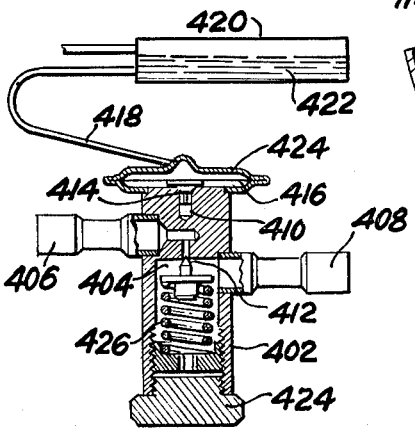
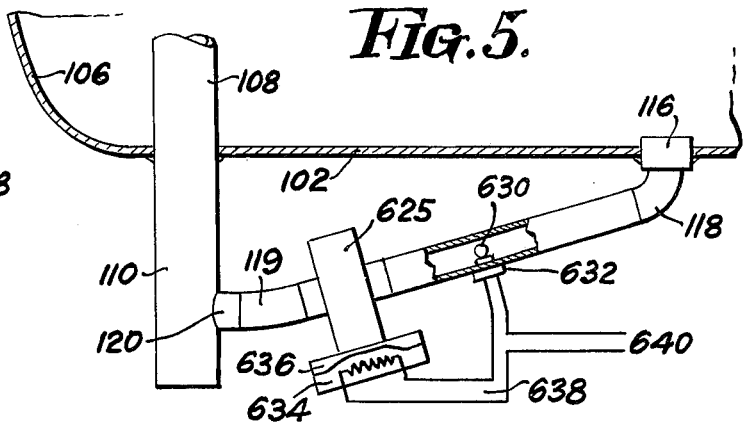
FIG. 5.

SUCTION ACCUMULATOR FOR REFRIGERATION SYSTEMS

BACKGROUND OF THE INVENTION

1. Field of the Invention

This invention pertains to the field of mechanical compression-type refrigeration which employs a condenser and evaporator, a volatile refrigerant and a compressor for withdrawing refrigerant vapor from the evaporator, raising its pressure and delivering it to the condenser for condensation. More specifically within that field, the invention relates to the area of suction line accumulators intended for installation in the suction conduit connecting the evaporator outlet and the compressor inlet. The purpose of these accumulators is the separation and retention of liquid refrigerant which from time to time might be delivered to it with the usual flow of refrigerant vapor from the evaporator, whether inadvertently by a malfunction of some control portion of the system, or intentionally.

2. Description of the Prior Art

The prior art discloses suction accumulators intended for location in the suction line of compression-type refrigeration systems intended for the interception and collection of liquid refrigerant and oil while at the same time allowing refrigerant vapor to flow unimpeded to the compressor. Even the simplest of these utilize some means for allowing the return of oil, circulated by the compressor with the refrigerant, such as an orifice port or metering tube so located as to drain the bottom of the accumulator tank and meter its contents into the outlet connection of the accumulator. These rudimentary accumulators of the prior art invariably had the characteristic that the metering assembly had sufficient flow capacity to return any reasonable quantity of the viscous oil circulated by the compressor. This same metering assembly, which had sufficient flow capacity to allow the return of the highly viscous oil, also had sufficient flow capacity to allow the flow of excessive quantities of the highly fluid liquid refrigerant under those conditions when the accumulator tank was partly filled with this refrigerant liquid. Up to the time of this invention, the prior art disclosed the following attempts to cope with this problem:

A. Interchangeable metering tubes to allow the size metering tube to be finally selected which had the smallest inside diameter which could return the oil circulated by the system.

B. Various venturi devices whose incentive for liquid return increased with the refrigerant vapor flow rate but which could not differentiate between viscous oil and fluid refrigerant liquid.

C. Heated metering tubes to warm the oil, allowing it to become less viscous and flow more readily through a small metering tube, or to boil away the liquid refrigerant before it could reach the outlet connection of the accumulator; or to cause sufficient bubbling in the liquid refrigerant that its flow characteristics would become similar to that of the viscous oil and the flow rate of the bubbling, foaming, liquid refrigerant through the metering tube would be tolerably low.

Unfortunately, none of these improvements have been sufficiently satisfactory to allow free flow of the circulated oil and to control the flow of liquid refrigerant from the partially filled accumulator to such a value that it would not harm a close-connected compressor, whose temperature was as low as the temperature of the flowing, liquid refrigerant.

BRIEF SUMMARY OF THE INVENTION

The invention teaches a suction accumulator including an inlet adapted primarily to receive refrigerant vapor from an evaporator. The refrigerant vapor is usually mixed with a small quantity of oil, but at times is mixed with a large quantity of liquid refrigerant which must be separated and collected in the accumulator tank. The tank has an outlet adapted to convey away the refrigerant vapor from which the liquid oil and liquid refrigerant has been separated so that the compressor can compress this liquid freely without hazard of damage from entrained uncompressible liquid. In the bottom of the tank is a port connected by conduit with the outlet connection of the tank. Within this conduit is an element intended to sense the presence of oil and the presence of liquid refrigerant to discriminate between them either on the basis of their specific gravity or their superheat with respect to the saturated temperature of the liquid refrigerant and to close the port in the presence of liquid refrigerant and to open the port in the absence of liquid refrigerant but the presence of oil. One such discriminating element is a thermostatic expansion valve who bulb is so positioned to sense the presence of liquid refrigerant in the tank. A second discriminating element is a float whose specific gravity is such that it will float in liquid refrigerant but sink in oil. The float is so arranged that it will move a port closing element so that when it is in a floating condition, because of the presence of liquid refrigerant in the tank, its elevated position causes closure of the metering conduit. When it is in a non-floating position, caused by the presence of oil or the lack of both oil and refrigerant, it leaves the metering conduit fully open, allowing unrestricted communication between the bottom of the tank and the vapor outlet connection of the accumulator.

BRIEF DESCRIPTION OF THE DRAWINGS

FIG. 1 is a cross-section of a suction accumulator which includes a tank, a vapor inlet, a vapor outlet, and a metering conduit joining the bottom of the tank to the vapor outlet, which includes a fluid actuated expansion valve as a discriminating device and which also includes an electric heater mounted on the tube adjacent the expansion valve for increasing the sensitivity of the expansion valve to the absence of liquid refrigerant.

FIG. 2 is a partial cutaway of a suction accumulator which includes vapor inlet and vapor outlet and a conduit controlled by an expansion valve connecting the bottom of the tank with the vapor outlet for allowing free flow of oil when no refrigerant is present and for stopping the flow through the conduit when liquid refrigerant is present, and refrigerant liquid passage through the suction accumulator for boiling away liquid refrigerant that might be collected; a liquid sensing tube communicating with the interior of the tank to which the expansion valve bulb is attached, and a thermal link connecting one or more of the liquid-refrigerant-carrying tubes with the liquid sensing tube to which the thermostatic expansion valve bulb is attached.

FIG. 3 is a cross-section of a typical thermal expansion valve which is used as a discriminating control element in the conduit connecting the bottom of the tank with the vapor outlet connection of the accumulator.

FIG. 4 is a cross-section of a portion of the bottom of the tank which includes a conduit draining the bottom of the tank and connected to the vapor outlet of the accumulator. The end of this conduit is opened and closed by a float which is adapted to rise in the presence of liquid refrigerant to close the end of the conduit to flow, forbidding the exit of liquid refrigerant which may have collected in the tank and to tall in the absence of liquid refrigerant, or in the presence or absence of oil, to allow the end of the conduit to fall in the absence of liquid refrigerant, or in the presence or absence of oil, to allow the end of the conduit to be opened, permitting free communication for the ready flow of viscous oil from the bottom of the tank to the vapor outlet connection of the accumulator.

FIG. 5 is a section of the bottom of a tank like that of FIG. 1 showing the liquid and vapor outlet portion which includes an electrically actuated expansion valve controlling the flow from the liquid outlet.

DETAILED DESCRIPTION OF THE DRAWINGS

FIG. 1 is a suction line accumulator for refrigeration systems which includes the improvement of this invention. The accumulator has a tank 100 with ends 104 and 106. There is a tube provided as an inlet, part of which (112) projects within the tank and part (114) projects outside the tank for use as an inlet connection. The joint between the tanks and the tube may be soldered, brazed, welded or sealed against the leakage of refrigerant in any other way. At the other end of the tank, an outlet tube is provided, part of which (108) projects outside the tank, and part of which (110) projects outside the tank and beneath it to form an outlet connection. In outlet connection 110 is a fitting 120 to which is connected smaller diameter tube 119. In the bottom of the tank 102 is a fitting 116 which communicates with the interior of the tank. To the outside portion of this fitting is connected a smaller diameter tube 118. Tube 118 is connected to the inlet fitting of an expansion valve 402. The outlet fitting of the expansion valve is connected to conduit 119. Therefore, there is a flow path established from the bottom of the tank to the outlet connection, comprising fitting 116, conduit 118, expansion valve 402, conduit 119 and fitting 120. The flow in this conduit, which we will henceforth refer to as the metering conduit, is controlled by the expansion valve 402, which is in turn under the control of its temperature-sensing bulb 420. This bulb communicates its temperature condition to the diaphragm casing 424 of the expansion valve 402 via its capillary 418.

FIG. 4 shows a detailed cutaway of this thermal expansion valve and a detailed discussion of its construction and operation will be found under the reference to that figure.

Included in the accumulator tank 100 in a position close to its bottom side 102 is a portion of the liquid line 128 which may comprise two or more tubes (see FIGS. 2 and 3). The liquid tubes 128 traversing the tank terminate in outlet manifold 130 with outlet fitting 132 on the outlet side and in inlet manifold 124 with inlet fitting 126 on the inlet side.

The operation of the suction accumulator is as follows: Refrigerant vapor received from the evaporator enters the accumulator through inlet fitting 114 and discharges its gas against the top of accumulator tank 100. There is normally contained in this refrigerant vapor a small proportion of oil, generally in the range of 1–10% by weight. This oil is deposited by its momentum against the inner wall of the tank and flows down the sides of the tank until it collects in a pool on the bottom of the tank 102. When sufficient oil collects to over-spill into fitting 116, flow will be allowed through conduit 118 and expansion valve 402 into the outlet fitting 120, since the bulb 420 of the expansion valve 402 will sense a condition of superheat in the flowing oil and will respond by opening. Valve 402 has a relatively large port and therefore allows relatively free flow of the viscous oil so that essentially the same quantity of oil reaches outlet fitting 110 as entered the accumulator through inlet fitting 114. The vapor, which has been separated from the particles of oil, flows from inlet fitting 112 across the top of the tank to outlet fitting 108 and leaves the tank through outlet fitting 110, mixed with any oil that has been delivered through opened expansion valve 402.

Under certain other conditions, generally related to abnormal or unexpected conditions, the refrigerant vapor entering the suction accumulator through its inlet fitting 114 will have entrained with it substantial quantities of liquid refrigerant. Those refrigeration men experienced in the art know that mechanical refrigeration compressors are designed to pump vapor and are easily damaged if liquid refrigerant is allowed to return to their inlets. Any liquid refrigerant which is conveyed into tank 100 through inlet tube 112 is spattered against the interior of the tank 100 and clings to the inside of the tank walls, running down to form a pool in the bottom of the tank 102. This liquid refrigerant which collects in the bottom of the tank has, by definition, 0° superheat, that is, its actual temperature is the same as its saturation temperature. The liquid refrigerant, being both an excellent solvent for the oil and of much greater density than the oil, tends to displace the oil from the bottom of the tank and from the interior of the conduit 118. As soon as liquid refrigerant reaches the interior of conduit 118 adjacent to bulb 420 the bulb becomes sharply chilled, sufficiently so for it to communicate its condition of essentially 0° superheat to pressure assembly 424, which in turn causes the valve 402 to close, preventing any further flow through it from the pool of collected refrigerant within the tank 100 to the outlet fitting 110 of the suction accumulator.

At this time there is a pool of liquid essentially trapped in the accumulator. In order to assure satisfactory continued operation of the refrigeration system, this refrigerant must be removed safely as quickly as possible. Two common methods for removal are shown: first, the utilization of small diameter metering tube 121 bypassing control expansion valve 402, whose internal diameter has been pre-selected to allow a satisfactorily small quantity of liquid refrigerant to flow through it under the pressure incentive conditions which are available in the accumulator. The internal diameter of this tube might be 0.060 inch for accumulators intended for use with systems up to approximately 3 HP, and 0.100 inch for accumulators intended for use with systems between 3 and 10 HP. In both cases, however, the internal diameter of this metering tube 121 is so small that under normal conditions of operation with no liquid refrigerant present, insufficient oil would be able to traverse this small tube to keep the compressor supplied with oil, and therefore valve 402 would have to be present and open under those conditions of no liquid refrigerant in order to assure an adequate return of oil from the bottom of the accumulator tank to the compressor.

When the liquid refrigerant in tank 100 has been metered away, that is, slowly dissipated through metering conduit 121, there will be no further liquid refrigerant adjacent bulb 420 and the bulb now will begin to warm and, through its capillary 418, signal the mechanism of expansion valve 402 that liquid refrigerant is no longer present and that it is, in fact, sensing superheat. Valve 402 will now open to establish a full-ported low resistance path for the return of normal quantities of oil from the bottom of the accumulator to the outlet connection 110.

Under certain conditions, it is undesirable to return even the smallest amount of liquid refrigerant to the suction line. These conditions will arise when both the compressor and the suction accumulator are located outdoors, subject to cold winter ambients. Under conditions of initial start-up, after long off-cycles, the compressor windings, stator, rotor and casing are cold, and the entry of even small quantities of liquid refrigerant would tend to seriously dilute the oil and interfere with proper lubrication of the close-fitting bearings because the cold compressor has no reserve heat to vaporize even this small flow of refrigerant. In that circumstance, liquid line 128 will be utilized to traverse the tank so that relatively warm liquid from the condenser or receiver can be put in heat exchange relation with the cold liquid in the tank, delivering up the heat contained in the warm high pressure liquid for the purpose of boiling off the liquid trapped in tank 100. The vapor resulting from this ebulition process will be conveyed to the compressor along with the other vapor entering fitting 114 through the outlet tube 108 and outlet connection 110 of the accumulator.

Where the suction accumulator is applied outdoors, on systems whose saturated suction temperature is 20° or higher, it is entirely likely that under even normal operating conditions, with no significant entrainment of liquid refrigerant with the suction vapor, that the suction vapor flowing will be cooled under low ambient conditions to a condition approaching 0° superheat. Bulb 420 then will be fooled into telling expansion valve 402 that it is subject to liquid refrigerant and valve 402 will close, cutting off conduit 118 for the normal return of oil necessary for compressor operation. In order to cope with this condition, low wattage heater 122 is provided, strapped to conduit 18 in such a way that bulb 420 is affected by the heater through heat conduction through the wall of tube 118 itself. When only vapor or oil is present, bulb 420 will be warmed by heater 122, even under low ambient conditions surrounding it and be able to correctly advise expansion valve 402 that it is subject only to oil or refrigerant vapor and that valve 402 should be open. However, under those abnormal conditions when large quantities of liquid refrigerant are deposited in accumulator 100, then the thermal path between heater 122 and bulb 420 will be broken by virtue of the refrigerant cooling the walls of tube 118 and preventing the communication of heat from heater 122 to the bulb. Therefore, the bulb will, on the presence of liquid refrigerant, signal valve 402 to close.

FIG. 2 is an isometric view of the accumulator shown in section in FIG. 1, having the same tank 100, inlet connection 114, outlet connection 110, control valve 402 with its capillary 418 and sensing bulb 420. In the structure of FIG. 2 there is a blind tube 302 open at one end soldered or brazed into the end cap 104 of tank 100. The interior of this tube is open to the interior of the accumulator. Bulb 420 is thermally attached as by strapping to this tube. Tube 302 is adjacent to conduit 128 which carries high pressure warm liquid from the condenser to the expansion device. Joining tube 128 and tube 302 is a thermal link 306 comprising a bar or plate of thermally conductive material, in this case copper, which is bonded by soldering 304 to one side of tube 302 and to high pressure liquid line tube 128. Under conditions where only oil is traversing the suction accumulator, the warmth from the liquid traversing tube 128 is communicated through the thermal link 306 to tube 302, which, in turn, is communicated to bulb 420, allowing positive indication to the thermal expansion valve 402 that no liquid refrigerant is present and that, therefore, valve 402 should be wide open. Under other conditions when liquid refrigerant has flowed into and resides in the bottom of tank 100, tube 302 will be filled, fully or partially, with liquid refrigerant, which will serve to sharply chill its periphery and negate any warming effect of the thermal link 306. Bulb 420 then will assume essentially the temperature of the liquid refrigerant in the tank 100 and the valve 402 will consequently be advised to close by virtue of the 0° superheat condition of the bulb 420.

FIG. 3 is a cutaway of a typical expansion valve well known to those skilled in the art of refrigeration of the type which is suitable for use in conduit 118, in conduit 119 to prevent the flow of refrigerant from the interior of the tank to the outlet connection in one condition and to allow free flow of circulating oil from the interior of the tank to its outlet connection under another condition. Bulb 420 contains fluid 422 which communicates through capillary 418 to diaphragm assembly 424. Within the diaphragm assembly is diaphragm 416, which is generally a sheet of stainless steel only a few thousandths of an inch thick. The diaphragm imposes its force on a pressure plate 414, which, in turn, pushes on a push rod 410, whose motion is communicated to the main globe 404 of the valve, which has a tapered conical pin 412, which opens and closes the port in the expansion valve, allowing, when open, and preventing, when closed, flow of fluid from valve inlet fitting 408 to valve outlet fitting 406. Spring 426 imposes a force which tends to oppose that of the pressure of the fluid 422 in the bellows. Adjustment of the valve to secure opening and closing under the desired superheat condition is achieved through adjustment screw 428, which, when turned in its threaded barrel, can either compress spring 426, preventing the valve from opening until higher superheat and therefore higher pressure is available at 420, or to relax the force on spring 426, allowing the valve to open with a lower temperature at 420 and therefore a lower force tending to move 412 off its seat.

FIG. 4 displays the same basic suction accumulator 100 as in FIG. 1, including inlet fitting 114, inlet tube 112, outlet tube 108 and outlet fitting 110, together with connection 120 in outlet fitting 110. Tank 100 has been modified by the addition of a float assembly 502 welded at 510 into the bottom 102 of the tank 100. The float assembly is closed by cover plate 504, gasket 506 and bolts 508. Inside the float assembly is float 518, whose density has been adjusted to sink in the presence of oil and to float in the presence of liquid refrigerant. A soft seat 516 has been supplied at the top of the float and attached to the float is guide 520 which tends to keep the float in an upright position by virtue of its restricted motion in tubular guide 512. The soft seat 516 seats against the open port 514 of oil return conduit 525. Note that this conduit is connected to conduit 119. During the course of normal operation, when only oil is being circulated with the refrigerant vapor, there will be no liquid refrigerant accumulated in the bottom of tank 102 or in the float chamber 502. Float chamber 502, however, will be filled with oil to a level approximately equal to the center line of conduit 520. So long as float chamber 502 is filled with oil, float 518 will rest on bottom plate 504, leaving sheet 514 of conduit 525 fully open for unrestricted and free flow of oil from the interior of the accumulator to the outlet connection 110 of the accumulator. Under circumstances where quantities of liquid refrigerant are carried into the suction accumulator along with the suction vapor, this refrigerant will, because of its greater density, displace from float chamber 502 all the oil. The greater density of the liquid refrigerant will cause greater buoyancy of float 518, causing it to lift, and under guidance of its pin 520, moving within guide 512, will cause the soft seat 516 to mate with face 514 of conduit 525, shutting off this conduit to any flow of liquid refrigerant therethrough. Though not shown in this drawing, liquid refrigerant accumulated in tank 100 can be dissipated in either of the ways shown in FIG. 1, that is, by the use of a small diameter metering tube 513 bypassing the float activated port and capable of allowing only a tolerable quantity of liquid refrigerant to drain into outlet connection 110, or by deliverately boiling off the refrigerant in the tank by exposing it to heat transfer from an external source of heat such as the traversing liquid line shown in FIG. 1. When the refrigerant has been completely boiled away, float 518 will sink again to the base plate 504, allowing port 514 in conduit 525 to be fully open for free and unrestricted flow of oil from the bottom of the accumulator to the outlet fitting 110 of the accumulator.

FIG. 5 is a section of accumulator 100, shown in FIG. 1, which includes part of the lefthand shell 106, the bottom 102, outlet fitting 110, and oil return fitting 116. In conduit 118 and 119 connecting the bottom of the tank with outlet fitting 110 is installed an expansion valve 625 whose actuation is electrical rather than by the force of an expanding fluid. Immersed in conduit 118 is a thermistor 630, connected by two wires through an epoxy feel in fitting 632. In the actuating element of valve 625 is an electric heater 634, acting on a bi-metallic element 636. Thermistor 630 is connected in series with heating element 634 and power, typically 24 volts AC, is applied to the leads 640. So long as vapor or oil is present in conduit 118 and surrounds thermistor 630, the thermistor will become relatively warm by virtue of the flow of electricity through it. In this warmed condition, its resistance will be relatively low, typically 100 ohms, allowing a significant flow of electricity to heater 634, causing bi-metallic element 636 to move in a direction to force the valve-opening element off its seat, positioning valve 625 in an open position. Under conditions where liquid refrigerant is returned to the accumulator, it will enter tank fitting 116 and conduit 118, displacing the oil that had been flowing therein. On contact of the cold refrigerant with warm thermistor 630, the thermistor will chill and its resistance will immediately rise to a value in the region of 500 to 1000 ohms, or higher, sharply reducing the amount of current flow which it allows to heater 634. Bi-metallic element 636, therefore, will chill and relax its opening pressure on the globe of valve 626, allowing it to close, stopping flow of liquid refrigerant from reaching accumulator outlet fitting 110.

Such a valve is commercially available from the Controls Co. of America, Div. of Singer Corporation, and, as described in their Bulletin R-205 dated September 1969. Those skilled in the art will recognize that the preferred embodiments described are merely exemplary of the present invention and may be altered and modified without departing from the true spirit and scope of the invention, as defined in the appended claims.

We claim:

1. Improved suction accumulator means adapted to be used in mechanical compression type refrigeration systems, said accumulator means comprising a tank having a vapor inlet, a vapor outlet, and liquid outlet means; wherein the improvement comprises: automatic control means for sensing the presence and absence of liquid refrigerant in said accumulator means; and valve means located in the liquid outlet means and subject to the control means, said valve means constituting means for restricting flow from said liquid outlet means in the presence of liquid refrigerant and for allowing flow from said liquid outlet means in the absence of liquid refrigerant.

2. An improved suction accumulator, as in claim 1, including temperature sensing means for sensing the temperature of the contents of the accumulator means and for causing the valve means to restrict flow in response to a drop in temperature of the temperature sensing means.

3. An improved suction accumulator, as in claim 2, where the temperature sensing means is fluid-actuated.

4. An improved suction accumulator, as in claim 2, where the temperature sensing means is electrically actuated.

5. An improved suction accumulator, as in claim 2, including a heat source positioned to affect the temperature sensing means.

6. An improved suction accumulator as in claim 5 where the heat source is electric.

7. An improved suction accumulator as in claim 5 where the heat source comprises conduit means for conveying high side fluid.

8. An improved suction accumulator as in claim 1 where the control means is density sensor operatively subject to the contents of the accumulator.

9. An improved suction accumulator as in claim 8 where the density sensor is a float.

10. An improved suction accumulator as in claim 1 which includes non-automatic metering means bypassing the control means.

11. An improved suction accumulator as in claim 1 where the automatic control means includes superheat sensing means subject to the contents of the accumulator means and where the control means activates the valve toward a closed position when the sensing means is subject to a reduced superheat.

12. The method of controlling a valve in the liquid outlet of suction accumulator means for holding refrigerant liquid, refrigerant vapor and oil, each having different values of a property, comprising the steps of:

1. sensing the property of the contents of the accumulator
2. closing the valve when the value of the property sensed approaches that of liquid refrigerant.

13. A method as in claim 12, which includes the step of sensing the density of the contents of the accumulator means.

14. A method as in claim 12, which includes the step of sensing the super heat of the contents of the accumulator means.

15. A method as in claim 12, which includes the step of sensing the temperature of the contents of the accumulator means.

16. A method as in claim 12, which includes the steps of; sensing the temperature of a lower portion of the accumulator means with a temperature sensor; applying an external source of heat to the sensor; and closing the valve when the temperature of the sensor decreases.

* * * * *

UNITED STATES PATENT AND TRADEMARK OFFICE

CERTIFICATE OF CORRECTION

PATENT NO. : 4,068,493

DATED : January 17, 1978

INVENTOR(S) : William Micai and Daniel Kramer

It is certified that error appears in the above-identified patent and that said Letters Patent are hereby corrected as shown below:

Cover Page: Delete "Assignee: Kramer Trenton Company, Trenton, N. J." and insert in its place -- Assignee: Kramer Trenton Company, Trenton, N. J., part interest --

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*